US007172312B2

(12) United States Patent
Chen

(10) Patent No.: US 7,172,312 B2
(45) Date of Patent: Feb. 6, 2007

(54) FLASHLIGHT WITH CHANGEABLE FILTER STRUCTURE

(75) Inventor: Joy Chen, Burlingame, CA (US)

(73) Assignee: Pentagon Scientific Corporation, Burlingame, CA (US)

( * ) Notice: Subject to any disclaimer, the term of this patent is extended or adjusted under 35 U.S.C. 154(b) by 16 days.

(21) Appl. No.: 10/861,395

(22) Filed: Jun. 7, 2004

(65) Prior Publication Data

US 2005/0168976 A1 Aug. 4, 2005

(30) Foreign Application Priority Data

Feb. 4, 2004 (TW) ..... 93201631 U

(51) Int. Cl.
*F21L 4/04* (2006.01)

(52) U.S. Cl. ..... 362/202; 362/208

(58) Field of Classification Search ..... 362/282–283, 362/202, 208, 322–323, 293; 285/332.2, 285/332, 391; 292/256.67; 403/370–371; 359/889, 892

See application file for complete search history.

(56) References Cited

U.S. PATENT DOCUMENTS 4,533,980 A * 8/1985 Hayes ..... 362/110
6,761,467 B2 * 7/2004 Matthews et al. ..... 362/202
7,004,600 B2 * 2/2006 Echterling ..... 362/187

OTHER PUBLICATIONS

Sure Fire Catalog, "Tactical Light and LAser Sight Product Selection Guide", pp. 13 and 16.*

* cited by examiner

*Primary Examiner*—Renee Luebke
*Assistant Examiner*—Robert May
(74) *Attorney, Agent, or Firm*—Rosenberg, Klein & Lee

(57) ABSTRACT

A flashlight with changeable filter structure comprising a cylindrical inner casing and a cylindrical filter base slides into the inner casing. The filter base comprises a female clasp and multiple hinge sets. On the exterior on the filter base, there are ribs and a gap. Multiple filter covers are provided and each filter cover comprises a cover and a filter. The cover is used to fix the filter. There is a hinge set on the filter cover. The hinge set is used to hook onto the hinge set of the filter base. In doing so, there are multiple filters available to meet different situation. Therefore, the operation is easier and more convenient, and saves the trouble of carrying many individual filters.

10 Claims, 7 Drawing Sheets

FLASHLIGHT WITH CHANGEABLE FILTER STRUCTURE

BACKGROUND OF THE INVENTION

1. Field of the Invention

The present invention relates to a filter structure. More specifically, the present invention discloses a filter structure that can be applied to a flashlight and filters that can be changed as needed.

2. Description of the Prior Art

The light of a common flashlight is white. Although white light is used for night illumination, it is not suitable for some other special illumination. For example, white light, when used at night, can easily be spotted. Therefore, a filter that can alter the color of illumination is needed.

If a filter is placed on the top of the light source, and if the filter is red, the light coming out of the flashlight is red. Red light would be suitable for night illumination, so that the user cannot be easily spotted. However, the visibility provided by red light is poor. Visibility could be improved, if blue light is applied. Thus, filters can provide many functions to a flashlight.

However, it would be inconvenient if the user had to change the filter when a different situation occurred. Therefore, how to solve the problems mentioned above is of concern.

Due to the inconvenience and trouble of existing products, a new generation of flashlight is needed which is provided with a changeable filter structure.

SUMMARY OF THE INVENTION

To achieve these and other advantages and in order to overcome the disadvantages of the conventional method in accordance with the purpose of the invention as embodied and broadly described herein, the present invention provides a flashlight with changeable filter structure. A plurality of filters is provided for different purposes and the process of changing filters is made more flexible and easier.

An object of the present invention is to provide a flashlight with changeable filters, in order to provide filters of different colors to suit different conditions, as well as saving the trouble of carrying many individual filters.

In order to achieve the purposes mentioned above, the present invention comprises a cylindrical inner casing, and a cylindrical filter base, which is screwed onto the inner casing. The filter base comprises a clasp and multiple hinges. There are ribs and gaps on the exterior of the filter. A cylindrical sealer ring with ribs in the interior is also provided. The ribs are used for joining the exterior ribs of the filter base. The invention further comprises multiple filter covers. The filter cover comprises a cover and a filter. The cover is used to fix the filter, where there is a set of hinges. The hinge set is built into the hinge set of the filter base. There is also a male clasp on the cover. The clasp can hook onto the female clasp of the filter base.

Alternatively, a single filter is attached to the body of the flashlight by a sealer nut. This single filter type reduces the complexity of the flashlight and is useful in applications where multiple filters are not required. This simplified filter does not require an inner casing because the filter base is made out of rubber, which provides enough friction. With this design, the filter cap does not flip open as the sealer ring secures the filter to the head of the flashlight.

These and other objectives of the present invention will become obvious to those of ordinary skill in the art after reading the following detailed description of preferred embodiments.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

In the drawings.

DESCRIPTION OF THE PREFERRED EMBODIMENTS

Figure 1:
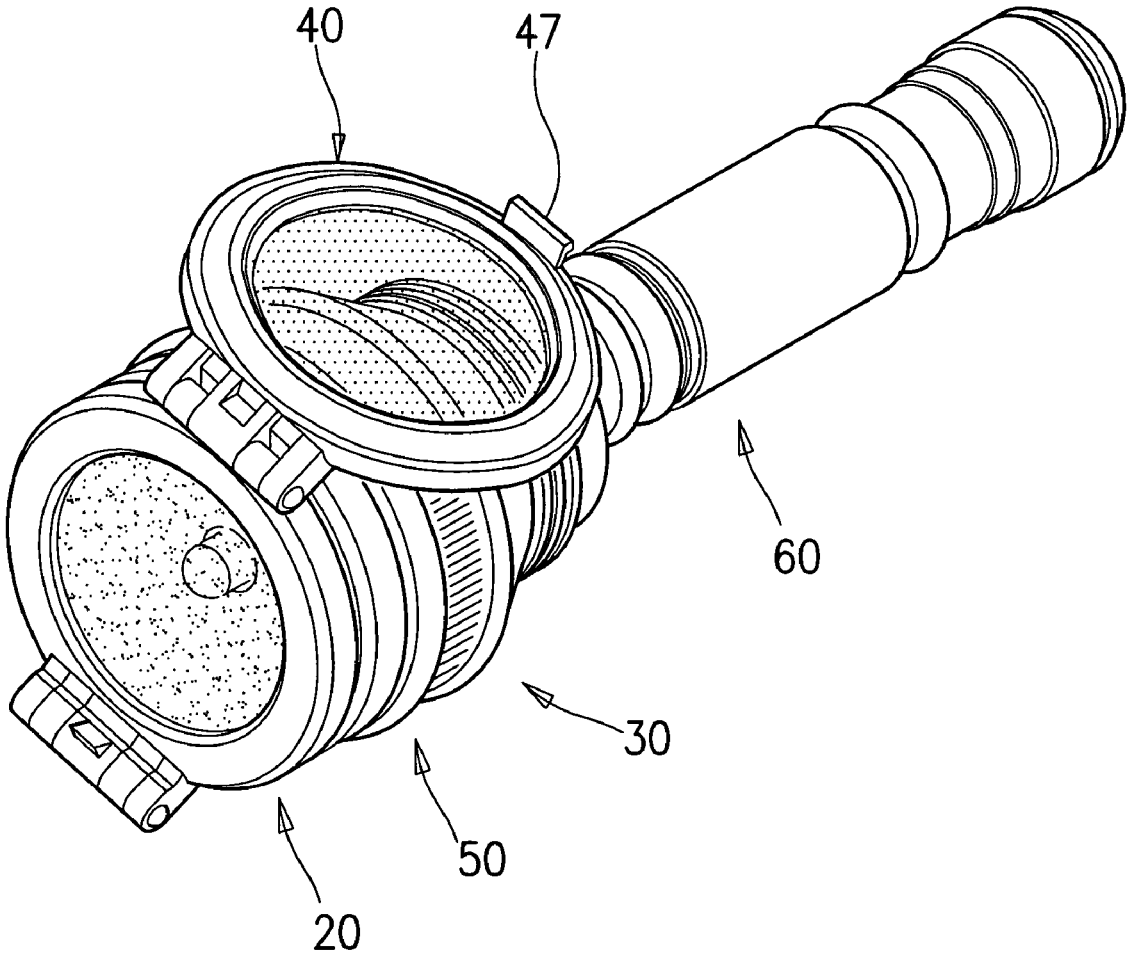
FIG. 1 is a 3D drawing illustrating a flashlight with changeable filter structure according to an embodiment of the present invention.

Reference will now be made in detail to the preferred embodiments of the present invention, examples of which are illustrated in the accompanying drawings. Wherever possible, the same reference numbers are used in the drawings and the description to refer to the same or like parts.

Figure 2:
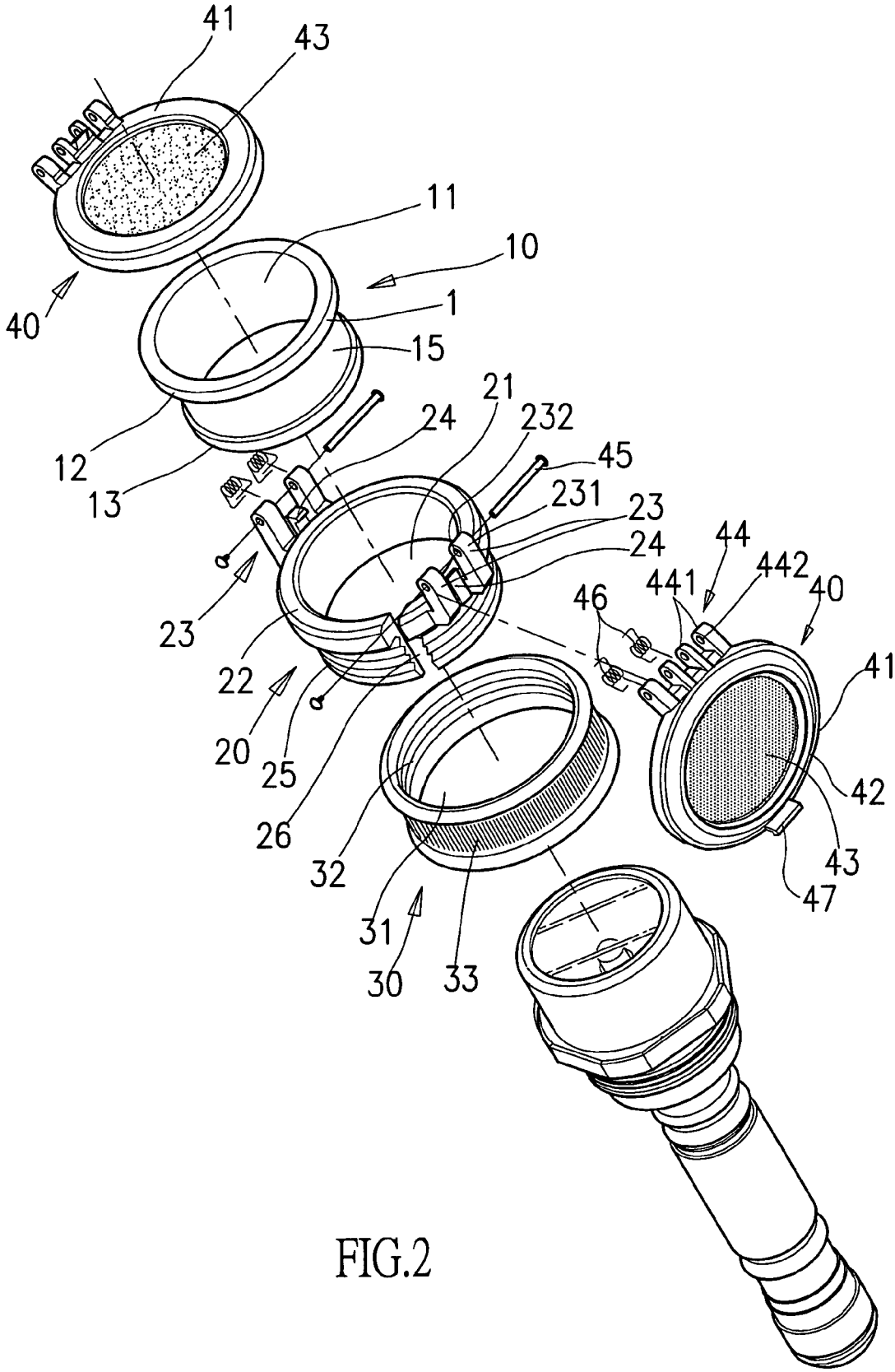
FIG. 2 is an exploded view illustrating a flashlight with changeable filter structure according to an embodiment of the present invention.
Figure 3:
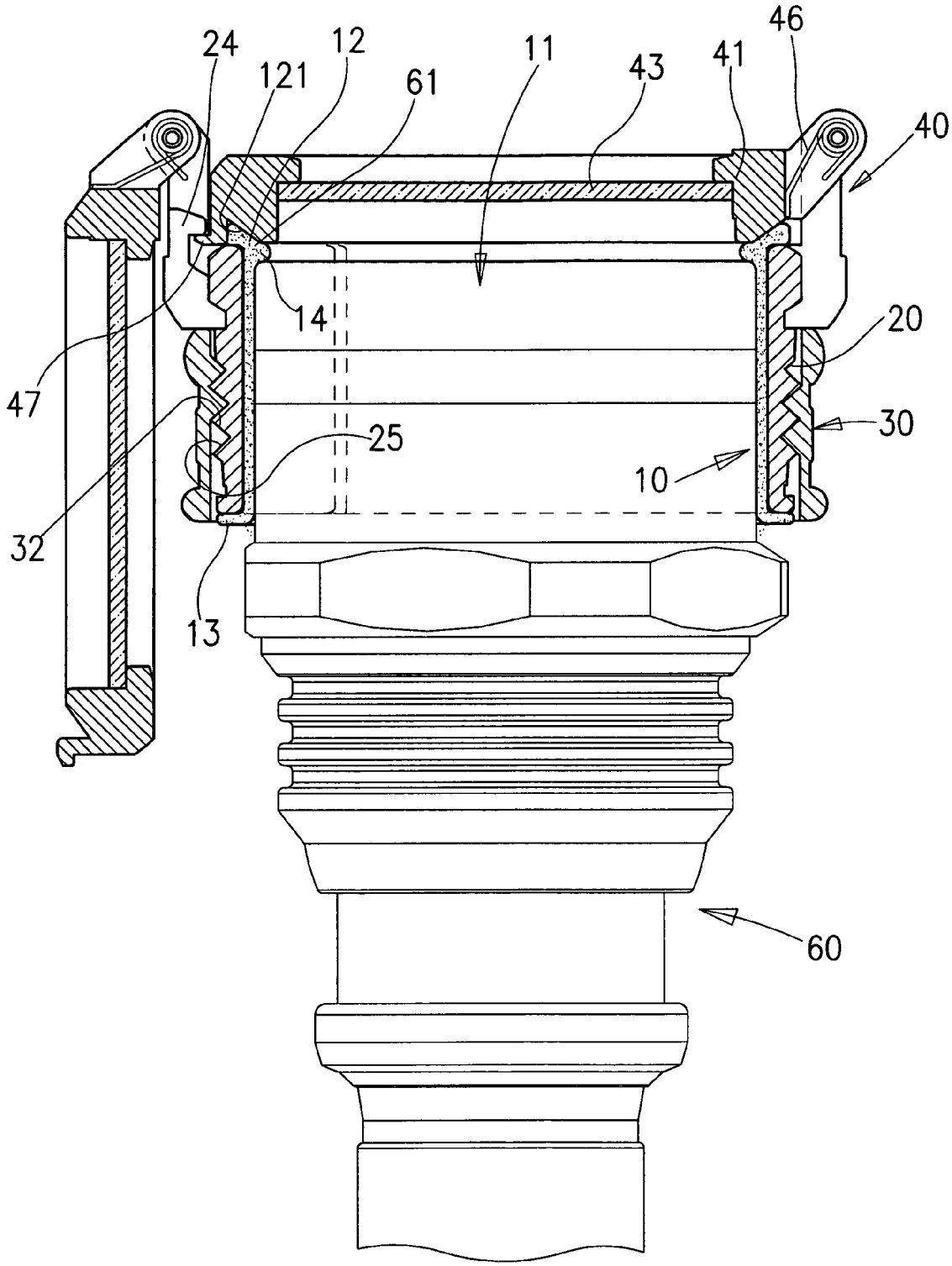
FIG. 3 is a partial cross section illustrating a flashlight with changeable filter structure according to an embodiment of the present invention.

Please refer to FIGS. 1–3. A flashlight with changeable filter structure comprises an inner casing 10, a filter base 20, a sealer ring 30 and multiple filter covers 40. The inner casing 10 is cylindrical, and comprises a hollow compartment 11, an upper male casing component 12 and a lower male casing component 13. After the filter base 20 is screw sealed by the sealer ring 30, an extra ring is squeezed out on the top of the hollow compartment 11. The top of the male casing component 12 is slightly beveled 121, and a concave 15 is formed between the upper male casing component 12 and the lower male casing component 13.

The filter base 20 is a cylindrical, which comprises a base hollow compartment 21. The base hollow compartment 21 is used to position the filter base 20 to the concave 15 between the upper male casing component 12 and the lower male casing component 13 of the inner casing 10. There is a male component 22 on the top of the filter base 20. There is a hinge set 23 on each side of the male component 22. The hinge set 23 comprises two individual hinges 231, where there is a pivot hole 232. There is a female clasp 24 between the two hinges 231. On the bottom of the upper male component 22, there is a male screw thread 25. There is also a gap 26 in the appropriate position of the filter base 20.

The sealer ring 30 is cylindrical, which comprises a sealer hollow compartment 31 and a female screw thread 32. The female screw thread 32 is used to screw onto the male screw thread 25 of the filter base 20. There are ribs 33 on the exterior of the sealer ring 30 to facilitate screwing the sealer ring 30 onto the filter base 20.

Figure 4:
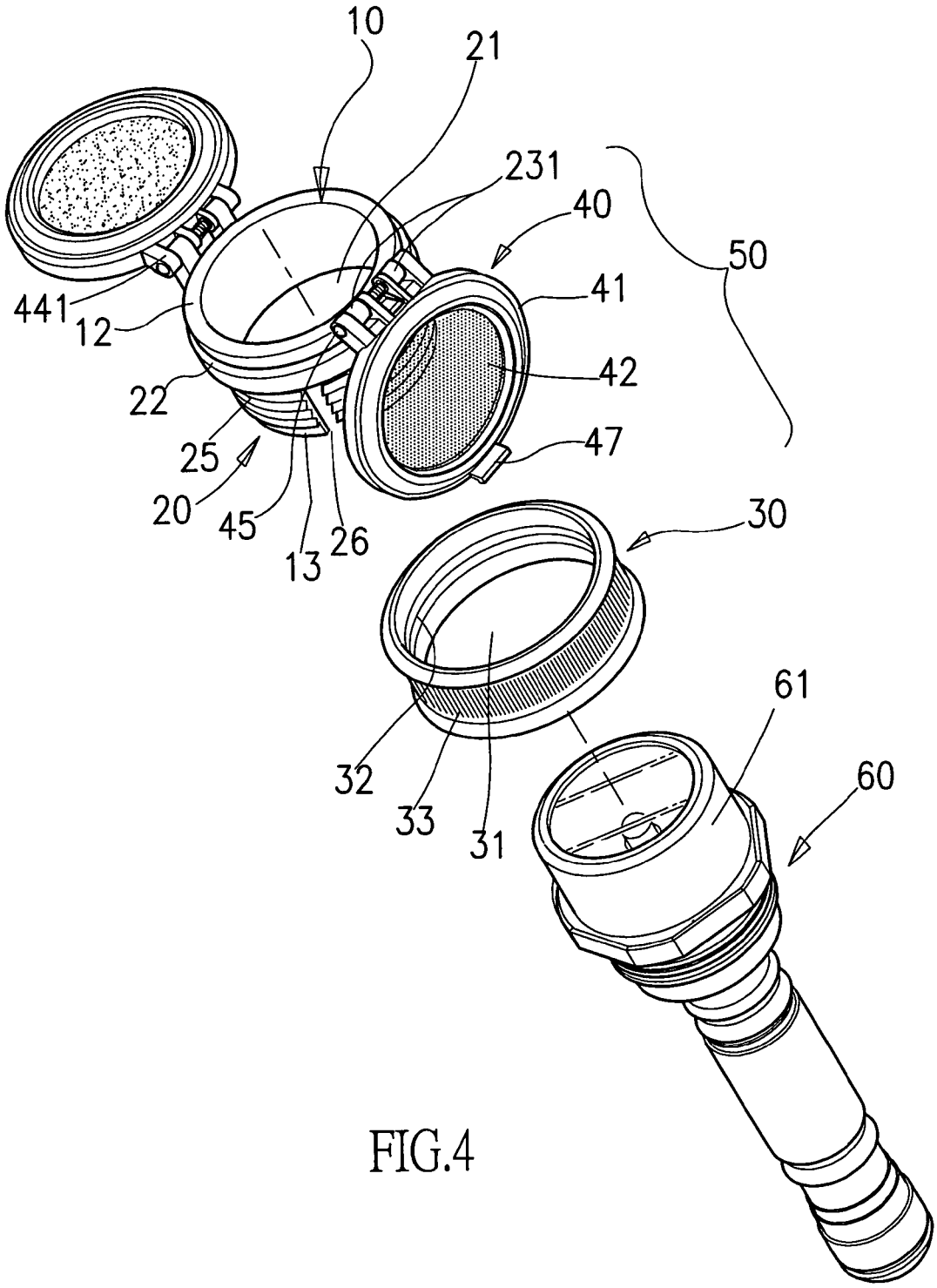
FIG. 4 is a partial exploded view illustrating a flashlight with changeable filter structure according to an embodiment of the present invention.

The multiple filter covers 40 comprise two filter covers 41. The filter covers 41 each comprise a cover 42 and a filter 43. The cover 41 is used to fix the filter 43 in the right position. There is a hinge set 44 on the cover 42. The hinge set 44 consists of 4 individual hinges 441. There is a hole 442 on each hinge 441. The hinge set 44 is embedded into the hinge set 23 of the filter base 20, and a pivot screw 45 pierces through holes 232 and 442 and locks them. In doing so, the filter cover 41 is fixed on to each side of the filter base 20. Furthermore, there is a hinge spring 46 on each side of the pivot screw 45 and it is positioned between the filter base 20 and the cover 42, in order to provide a resistance force when opening the filter cover 41. Finally, there is a male clasp 47 on the cover 42, Please refer to FIG. 4. First install the filter cover 41 to the filter base 20, so that the two filter covers 41 are on each side of the filter base 20. Then insert the filter base 20 into the inner casing 10. Finally, screw the sealer ring 30 onto the male screw thread 25 of the filter base 20, in order to form the whole filter cover set 50. And then, screw the filter set 50 onto the head 61 of the flashlight 60 until the head 61 touches against the extra ring 14 of the inner casing 10. Due to the male and female thread of the sealer ring 30 and filter base 20 joining and the gap being tightened, the filter base 20 can tightly fix the filter cover set 50 to the flashlight 60, such as shown in FIG. 1, which is a drawing of the unit after assembling. Of course, if the user desires to remove the filter cover set 50, then simply unscrew the sealer ring 30 to release the tightening between the filter base 20 and the inner casing 10 and head 61, so that the filter cover set 50 is removed.

When a filter cover 41 is desired to be used, close the filter cover 41 to the other side and make the male clasp 47 clasp onto the female clasp 24 of the filter base 20.

When the user wants to release the used filter cover 41 or change to a different filter cover 41, then lift the already used filter cover 41 up, by releasing the male clasp 47 and the female clasp 24. Then the hinge spring 46 helps the filter cover 41 to flip open, so that the filter cover 41 is no longer facing towards head 61 of the flashlight 60. Finally, repeat the same operation to cover another filter cover 41.

Figure 5:
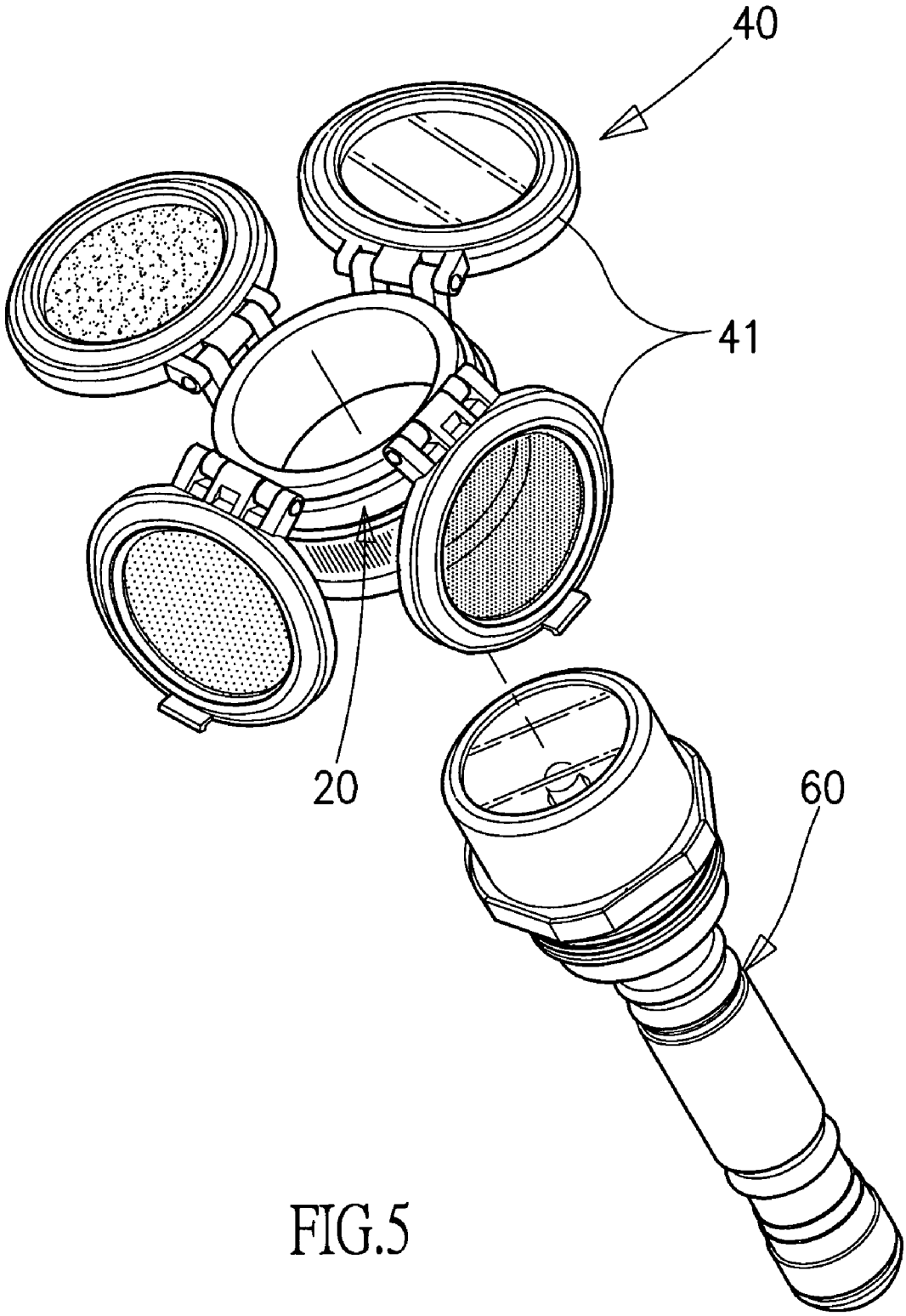
FIG. 5 is a diagram illustrating the installation of 4 filters of a flashlight with changeable filter structure according to an embodiment of the present invention.

Please refer to FIG. 5, the 4 filter covers 41 are placed on the 4 sides of the multiple filter cover 40, in order to increase the choices of filters colors and functions.

Figure 6:
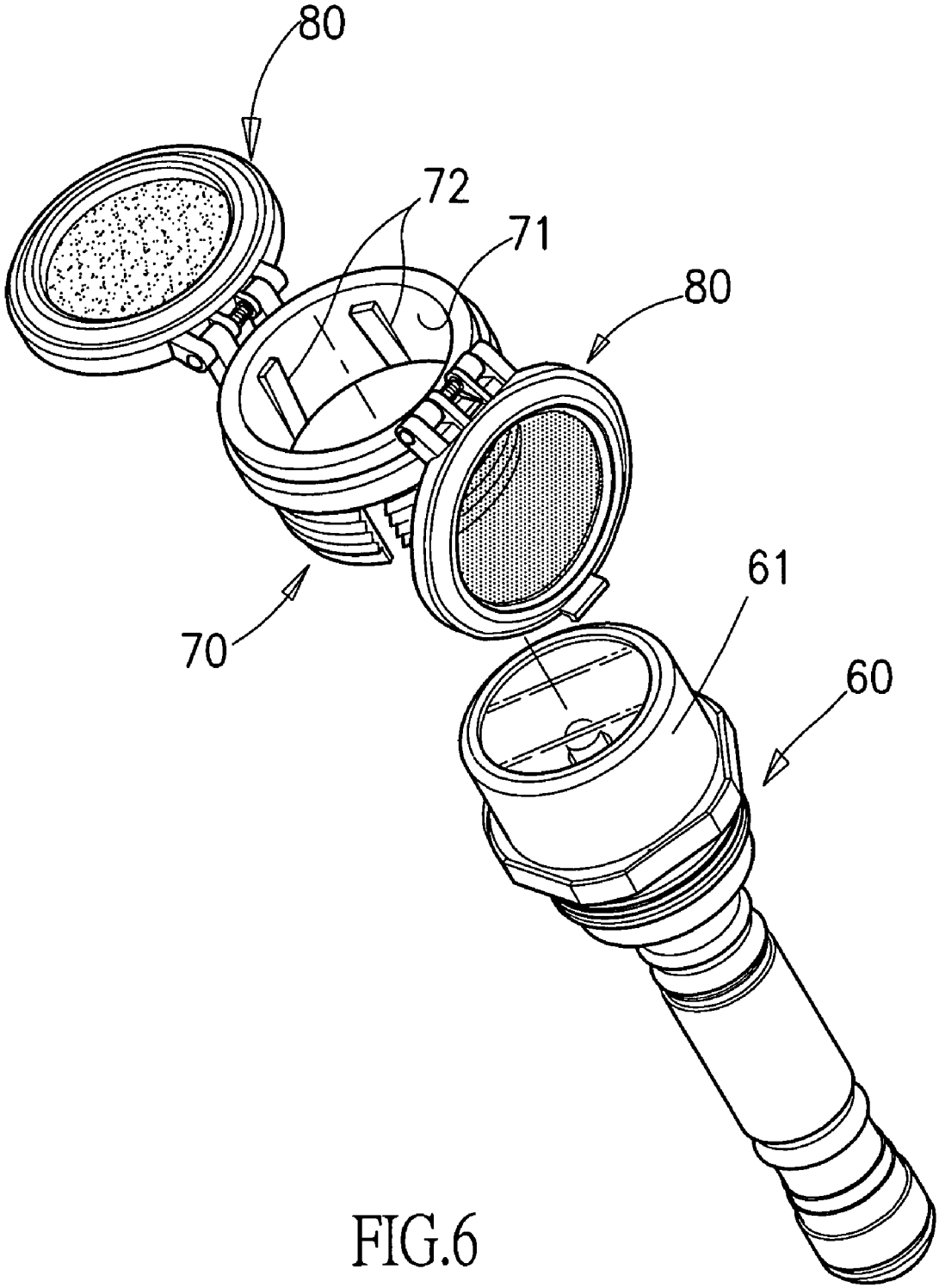
FIG. 6 is a diagram illustrating a flashlight with changeable filter structure according to an embodiment of the present invention.

Please refer to FIG. 6, which is another embodiment of the present invention. It comprises a filter base 70 and multiple filter covers 80. The assembling structure between the filter base 70 and the multiple filter covers 80 is the same as mentioned above. There are one or multiple stop points 72 on the inner-side 71 of the filter base 70. The filter base 70 sits on the head 61 of the flashlight 60, and due to the stop point 72, the head 61 gradually tightens itself to the filter base 70.

The flashlight with changeable filter structure of the present invention allows the filters of the flashlight to become more multi-functional, and also saves the trouble of carrying many individual filters. In the meantime, there are clasps amongst the filter covers that make operation easier and more economical.

Alternatively, in embodiments of the present invention, the inner casing is not required. In these cases, the filter base is made out of rubber, pliable, or flexible material, therefore combining the inner casing with the filter base.

Figure 7:
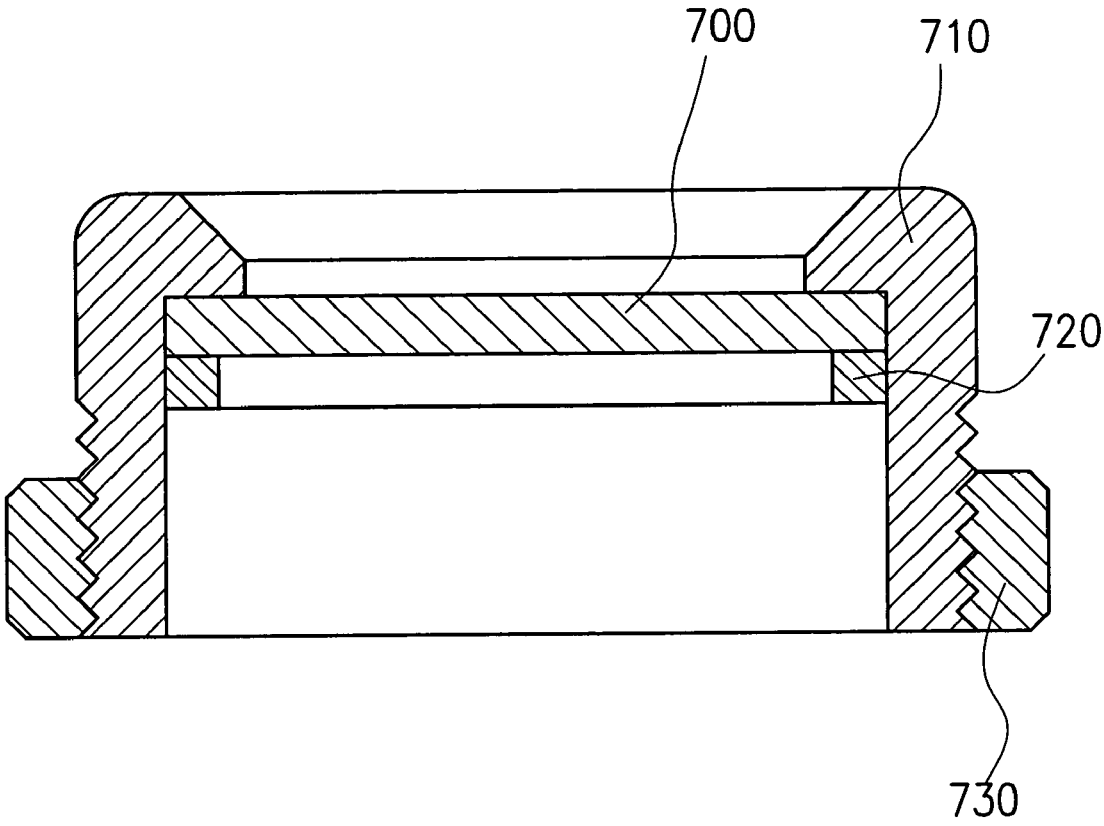
FIG. 7 is a diagram illustrating a flashlight with a single filter structure according to an embodiment of the present invention.

Refer to FIG. 7, which is a diagram illustrating a flashlight with a single filter structure according to an embodiment of the present invention. In this embodiment of the present invention, a single filter 700 is attached to the body of the flashlight by a sealer nut 730. This single filter type reduces the complexity of the flashlight and is useful in applications where multiple filters are not required. This simplified filter does not require an inner casing because the filter base 710 is made out of rubber, which provides enough friction. With this design, the filter cap does not flip open as the sealer ring secures the filter to the head of the flashlight. Therefore, no hinge or clasp are required for this embodiment. A lock ring 720 holds the filter 700 in position and against the inside of the filter base 710.

It will be apparent to those skilled in the art that various modifications and variations can be made to the present invention without departing from the scope or spirit of the invention. In view of the foregoing, it is intended that the present invention cover modifications and variations of this invention provided they fall within the scope of the invention and its equivalent.

What is claimed is:

1. A flashlight with changeable filter structure comprising:
- a cylindrical filter base;
- a first clasp and a plurality of hinge sets formed on the filter base;
- a set of screw threads on an exterior of the filter base and a gap formed through a sidewall thereof;
- a cylindrical sealer ring, having a set of screw threads on an interior for screwing onto exterior screw threads of the filter base;
- at least one filter cover set having a cover and a filter on each filter set, the cover for fixing the filter;
- a at least one filter cover hinge set formed on said filter cover for joining with a respective one hinge set of said multiple hinge sets of the filter base; and
- a second clasp on the at least one filter cover hinge set for clasping onto the first clasp of the filter base.

2. The flashlight with changeable filter structure of claim 1, further comprising a cylindrical inner casing, whereby the cylindrical inner casing slides into the cylindrical filter base.

3. The flashlight with changeable filter structure of claim 2, further comprising an upper inner casing component and a lower inner casing component on the exterior of the inner casing.

4. The flashlight with changeable filter structure of claim 2, further comprising an extra ring which is squeezed out when assembling the top of the inner casing.

5. The flashlight with changeable filter structure of claim 1, further comprising a first component on the top of the filter base.

6. The flashlight with changeable filter structure of claim 1, further comprising a pivot screw and hinge springs of the hinge set of the filter base and filter cover.

7. A flashlight with changeable filter structure comprising:
- a filter base with external threads for sliding onto the flashlight;
- a cylindrical filter; and
- a sealer nut with internal threads for securing the filter base to the flashlight.

8. The flashlight with changeable filter structure of claim 7, further comprising an inner casing, the inner casing sliding into the filter base.

9. The flashlight with changeable filter structure of claim 7 further comprising a lock ring inside the filter base for holding the filter in place.

10. A flashlight with a changeable filter structure comprising:

an inner casing;

a filter base having multiple filter base hinge sets and a filter base clasp received thereto, said inner casing slidingly insertable within said filter base and;

a plurality of filter covers, whereby two or more are aligned each with respect to the other to permit light output from a flashlight to be modified by said respective filters, each filter cover having a filter and a cover to fix the filter, each of said filter covers having a filter cover hinge set for matingly interfacing with a respective filter base hinge set, a second clasp formed on each of filter covers for clasping a respective filter base clamp, whereby said filter covers when closed over said filter base sealingly engages said filter base and said inner casing is frictionally engageable with a head of said flashlight.

* * * * *